United States Patent [19]

Kurtz

[11] 4,158,914

[45] Jun. 26, 1979

[54] HAND SHEAR FOR OPENING DISPENSING CARTRIDGES

[76] Inventor: Thomas D. Kurtz, 1101 First Ave., Rock Falls, Ill. 61071

[21] Appl. No.: 902,823

[22] Filed: May 4, 1978

[51] Int. Cl.[2] ..... B26B 13/22

[52] U.S. Cl. ..... 30/359; 30/233; 30/131

[58] Field of Search ..... 30/123, 124, 226, 233, 30/253, 359, 112, 131, 134

[56] References Cited

U.S. PATENT DOCUMENTS

| | | | |
|---|---|---|---|
| 1,644,936 | 10/1927 | Mertens | 30/226 X |
| 1,717,925 | 6/1929 | Horix | 30/112 |
| 2,516,959 | 8/1950 | Coull | 30/131 |
| 2,527,735 | 10/1950 | Johnson | 30/226 |
| 3,105,614 | 10/1963 | Sherbondy | 30/112 X |
| 4,092,774 | 6/1978 | Watts | 30/134 X |

*Primary Examiner*—Jimmy C. Peters
*Attorney, Agent, or Firm*—Morsbach & Pillote

[57] ABSTRACT

A hand tool for opening the tapered plastic dispensing tip on material dispensing cartridges which includes first and second lever members pivotally interconnected at one end and each having a handle with finger receiving openings at the other end to enable operation of the tool with one hand, one lever member having a blade portion intermediate its ends formed with a plurality of openings of relatively different size corresponding to the external cross-section of the tapered tip at different locations therealong, and the other of the lever members having a sharpened blade adapted to shear off a portion of the tapered dispensing tip when it is inserted through one of the openings. A probe is provided on the tool adapted for insertion through the dispensing tip to rupture the seal in the cartridge.

6 Claims, 5 Drawing Figures

12
11
10
21a
21
18b
21b
19
15a
15
16f
2
16e
2
18d
18e
26
31
16d
11a
18a
16g
19
16a
16c
22b
32
18c
18
16b
22
22a
13
14
14a
13a

T
18a
21b
16d
18
15a
15
11a
16g
C

HAND SHEAR FOR OPENING DISPENSING CARTRIDGES

BACKGROUND OF THE INVENTION

It is common practice to use material dispensing cartridges for dispensing various semi-fluid materials such as caulking compounds, sealing compounds, adhesives and the like. Such material dispensing cartridges include a relative rigid tubular body for receiving a quantity of the material to be dispensed, a tapered plastic dispensing tip at one end of the body and a movable closure plug at the other end which can be advanced through the body by the plunger on a cartridge dispensing gun, to force material from the body through the dispensing tip after it has been opened. Different materials and different applications require the use of material beads of different size and, when opening the dispensing tip, it is necessary to cut off the tapered tip at a location therealong in which the cross-sectional flow area corresponds to the desired size of the bead. The size and appearance of the bead is important to many applications, and it is necessary to not only cut off the tip at the proper location to give the desired size of bead, but to also form a clean cut free of burrs or feathered edges.

At present, it is the common practice to use a knife, razor or other sharp cutting tool to cut off the tip at a location that is gauged by the eye of the worker. Visual gauging of the point of cutting of the tapered dispensing tip is not precise and frequently results in variations in the size of the dispensed bead not only by different workers, but even when the same worker cuts the dispensing tip on successive cartridges. This variation in the size of the beads dispensed not only adversely affects the appearance of the job but also causes waste of material if the bead is oversize and may result in faulty sealing or adhesion if the bead is undersize. Further, the use of a knife or other sharp cutting tool to open the cartridges is a somewhat tedious operation. It is necessary to open or unsheath the knife or other sharp cutting tool, place the tip on a cutting surface, cut the tip and thereafter reclose or resheath the knife. In addition, cartridges commonly have a rupturable seal at the inner end of the dispensing tip, and it is necessary to use some elongated instrument other than the knife or cutter to rupture this seal. This necessitates either carrying another elongated tool or instrument or searching around for something such as a stick or wire which can be inserted through the cut-off dispensing tip to rupture the seal at the inner end of the tip.

SUMMARY OF THE INVENTION

It is the object of the present invention to overcome the disadvantages of the prior art by providing a tool for opening the tapered dispensing tip on a material dispensing cartridge which can be manipulated with one hand to cut off the tapered dispensing tip at any one of a plurality of different mechanically gauged locations along the tip to form a dispensing opening of the desired size.

Another object of this invention is to provide a tool for opening the tapered dispensing tip on a dispensing cartridge which can be used for cutting off the tapered dispensing tip at a preselected location therealong to open the tip, and which can also be used to rupture the seal at the inner end of the dispensing tip to allow material from the cartridge to flow into the tip.

Accordingly, the present invention provides a hand shear for opening the tapered plastic dispensing tip on a material dispensing cartridge and which includes first and second lever members pivotally interconnected at one end for movement in a pivot plane relative to each other and having handle portions with finger receiving openings at the other end to enable the shear to be held and operated by one hand. One lever member has a first shear blade portion at a location intermediate the pivot and the handle providing a shear face generally paralleling the pivot plane and having a plurality of openings extending therethrough of relatively different size generally corresponding to the external cross-section at different locations along the tapered dispensing tip to limit insertion of the tapered tip to a position in which the cross-section of the tip corresponds to the size of the opening and to peripherally support the dispensing tip during shearing, the second lever having a second shear blade portion extending laterally thereof with a sharpened free edge movable across the shear face on the first blade portion to shear the dispensing tip when it is inserted through one of the openings, and spaced blade guide members on the lever member having a portion overlying the outer side of the secondary portion along its side edges to guidably maintain the free edge of the second blade portion in engagement with the shear face on the first blade portion when the lever members are moved relative to each other.

The handle is also advantageously provided with a probe which is movable between an inoperative position extending alongside one of the lever members to an operative position in which the free end of the probe is spaced from the lever members to enable insertion of the probe into the dispensing tip to rupture the seal at the end of the dispensing tip.

These, together with other objects, features and advantages of this invention will be more readily understood by reference to the following detailed description, when taken in connection with the accompanying drawings wherein.

Figure 1:
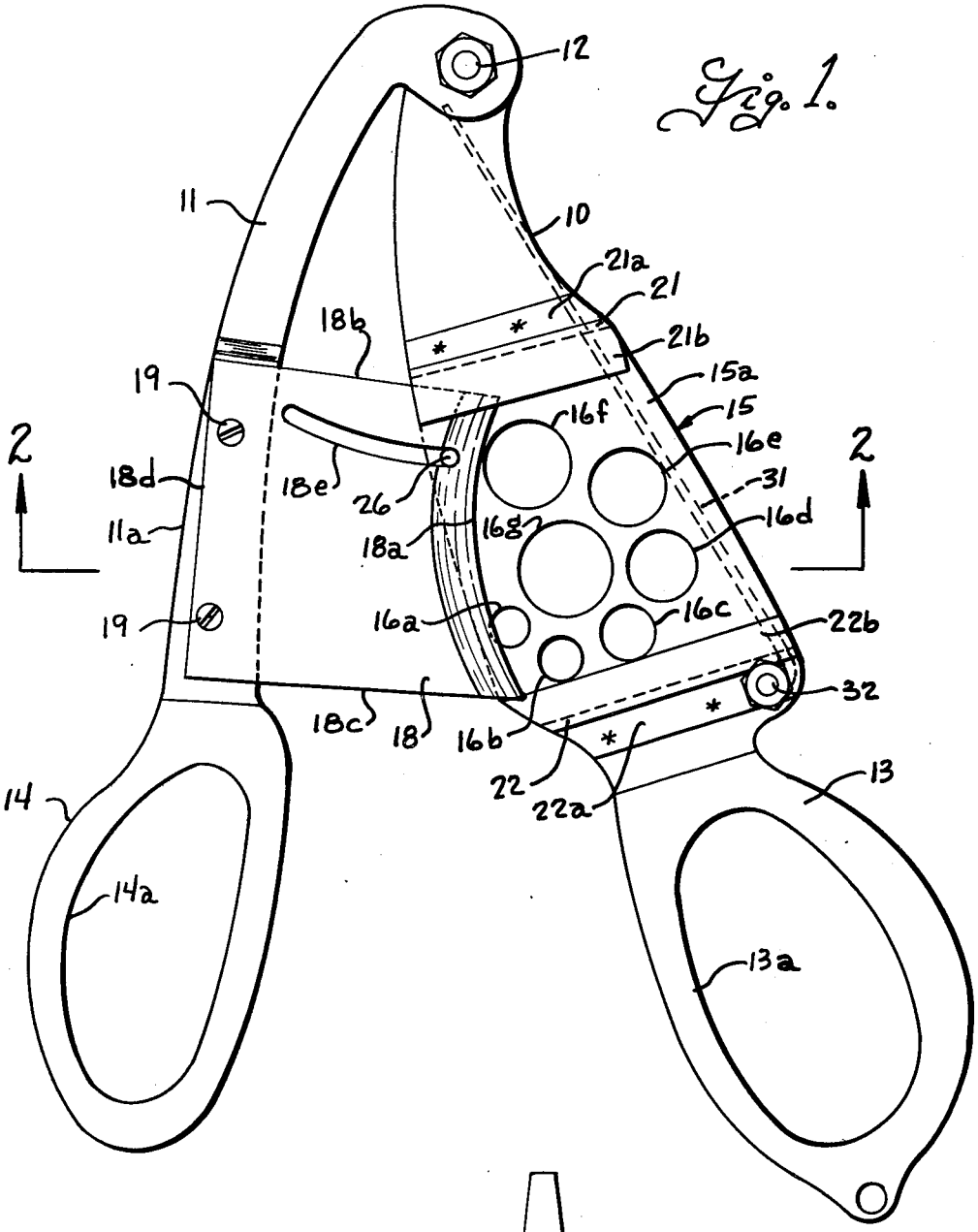
FIG. 1 is a side elevational view of one side of the hand shear in an opened position.

The hand shear is constructed for opening conventional material dispensing cartridges C of the type having a tubular body with tapered plastic dispensing tip T at one end and a rupturable seal (not shown) across the inner end of the dispensing tip to normally prevent the material in the cartridge body from entering the dispensing tip until the cartridge is used in a dispensing operation. The hand shear is shown substantially full size in FIGS. 1–4 and comprises first and second lever members 10 and 11 which are pivotally interconnected by a pivot means 12 for movement relative to each other in a pivot plane. The lever 10 has a hand portion 13 at the end remote from the pivot 12 and a finger receiving opening **13*a* in the handle. Lever 11 also has a handle 14 at the end remote from the pivot with a finger receiving opening 14*a* in the handle. Lever 10 has a relatively wide shear blade portion 15 intermediate the pivot 12 and the handle 13 and a plurality of openings arranged within a confined locus in the blade portion 15, which openings have a relatively different size each generally corresponding to the external cross-section of the tapered tip at different locations therealong. The openings are sized in relatively small increments, for example increments in the order of 1/16 of an inch, and a plurality of such openings are provided in sufficient number to accommodate the desired range of openings for the dispensing tip. In the embodiment shown, seven openings designated 16a–16g are provided in the blade portion 15 and vary in about 1/16 inch increments from ¼ inch to ⅝ inches. The smaller size openings 16a–16f are conveniently arranged in a semicircular pattern about the larger opening 16g to minimize the overall size of the pattern of openings in the blade portion with a view to minimizing the size and movement of the shear blade required for the tool. A generally flat shear face 15a is provided at one side of the blade portion 15 and, preferably, the openings 16a–16g are tapered toward shear face 15a at an angle somewhat greater than the angle of taper of the dispensing tip so as to provide the minimum hole diameter at the shear face 15a**.

Figure 2:
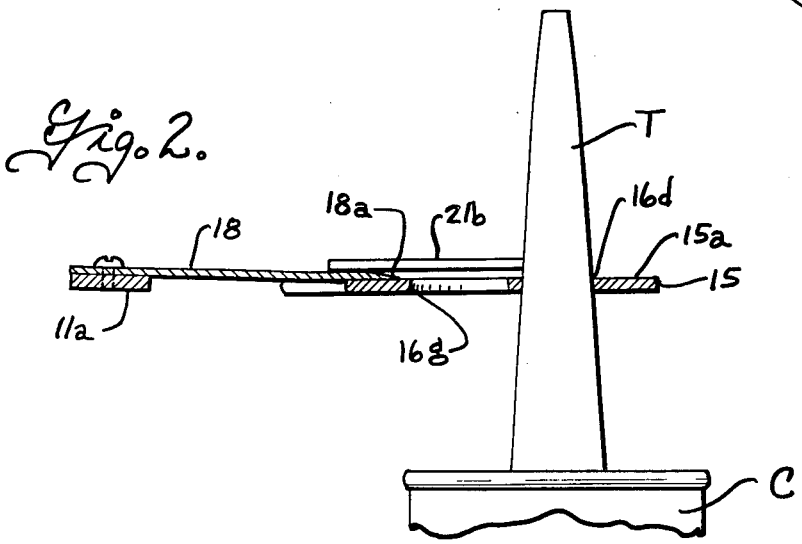
FIG. 2 is a transverse sectional view taken on the plane 2—2 of FIG. 1.
Figure 3:
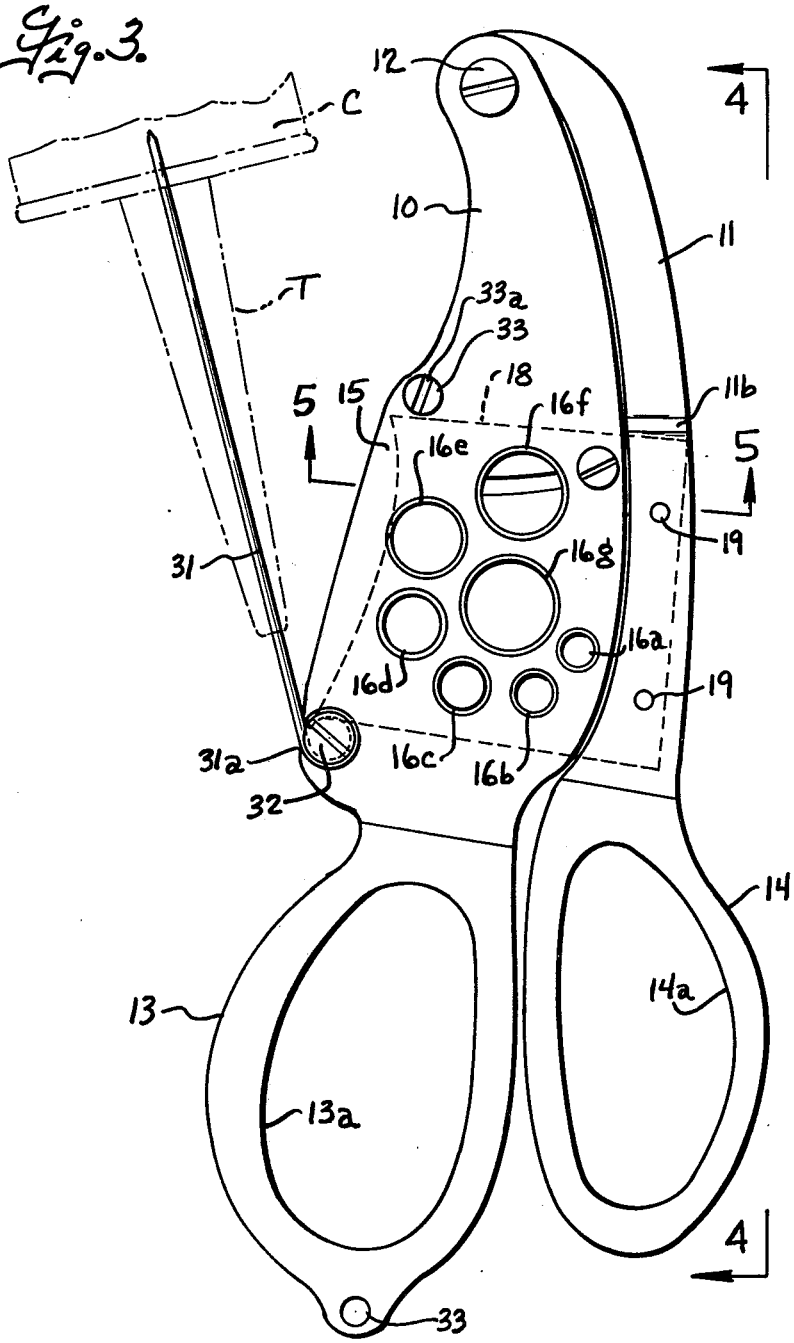
FIG. 3 is a side elevational view of the other side of the hand shear in a closed position.
Figure 4:
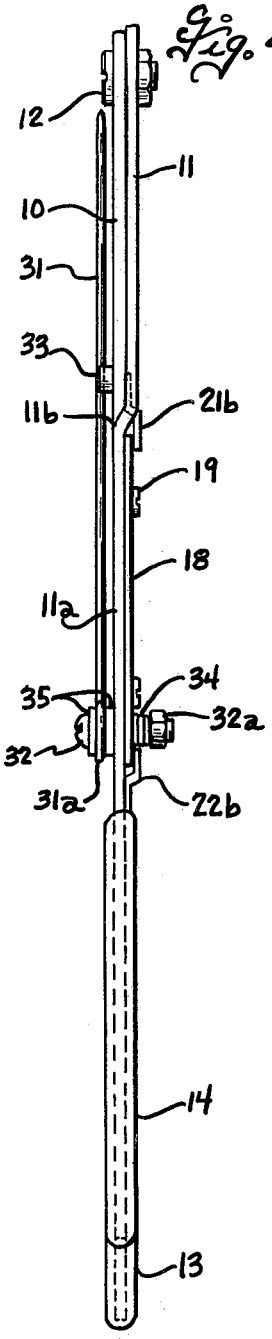
FIG. 4 is an edge elevational view taken on the plane 4—4 of FIG. 3.
Figure 5:
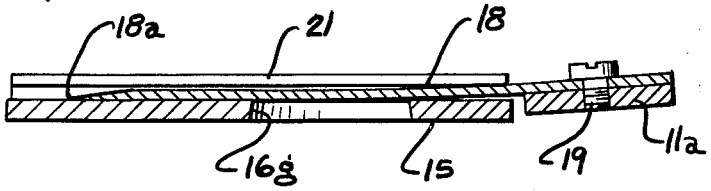
FIG. 5 is a transverse sectional view taken on the plane 5—5 of FIG. 3 and illustrating the parts on a larger scale.

The lever 11 has a blade 18 extending laterally thereof for movement across the shear face 15a on the blade 15. The blade has a sharpened free edge 18a, inner and outer side edges 18b and 18c, and a rear edge 18d. Blade 18 is preferably detachably secured to the lever 11 to facilitate the placement and/or sharpening of the blade and, as shown, is attached adjacent its rear edge 18d to the lever by screw fasteners 19 that extend through openings in the blade and into threaded openings in the lever. Inner and outer blade guides 21 and 22 are attached to the lever 10 at locations radially inwardly and outwardly relative to the pivot 12 from the locus of the openings 16a–16g, and are arranged to engage the outer side of the blade 18 on the lever 11, along the inner and outer side edges 18b and 18c thereof, to guidably maintain the blade 18 in sliding engagement with the shear face 15a of the blade 15. The guides 21 and 22 each have a mounting flange 21a, 22a respectively that is rigidly secured as by welding, fasteners or the like to the lever 10, and a blade guide portion 21b, 22b respectively that is spaced from the blade 15 a distance only slightly greater than the thickness of the blade 18 to guidably engage the outer side of the blade 18. Blade 18 is advantageously formed of a sheet of flat, resilient metal and the lever 11 is formed with an offset 11b such that the blade mounting portion 11a and handle 14 on the lever 11 are disposed generally in the same plane as the shear blade portion 15 and handle 13 on the lever 10, as best shown in FIG. 4. The blade mounting portion 11a on the lever 11 is preferably inclined at a shallow angle relative to the shear face 15a on the blade portion 15, as best shown in FIGS. 2 and 5, so as to provide a blade mounting surface that converges at a shallow angle, for example of the order of about two to four degrees relative to the shear face 15a, to thereby support the shear blade 18 in converging relation to the shear face 15a. In this manner, the sharpened free edge 18a of the shear blade 18 is maintained in close sliding engagement with the shear face 15a on the blade 15, to enable shearing of the dispensing tip without formation of burrs or feathered edges on the severed end of the tip. Stop means is provided to limit movement of levers between an open position in which the cutting edge 18a of the blade 18 remains in overlapping relation with the blade portion 15 but is disposed outside the locus of the openings 16a–16g as shown in FIG. 1, and a closed position in which the cutting edge of the blade extends completely across all of the openings in the blade 15 as shown in FIG. 3. The stop means is conveniently in the form of a pin 26 secured to the blade portion 15 and which extends through a slot 18e in the blade 18, the slot 18e being arcuate about the center of the pivot 12.

The levers 10 and 11 can conveniently be formed by stamping from sheet stock so that the handle portions are integral with the levers and, advantageously, the handle portions 13 and 14 are coated as by dipping, molding or the like with a covering material such as plastic which can then be set or cured to provide cover for the handles.

The material dispensing cartridges C also have a rupturable seal formed of paper, thin plastic or the like at the inner end of the tapered tip T to normally prevent the material in the cartridge from entering the tip. It is necessary to rupture the seal prior to dispensing and a probe 31 is provided on the hand shear for rupturing the seal. Probe 31 comprises an elongated piece of wire or rod formed with a loop 31a (FIG. 3) at one end that is pivotally attached as by a bolt 32 to the lever 10 adjacent the handle portion 13, to enable movement of the probe from an inoperative position shown in phantom in FIG. 1 extending alongside the lever, to an operative position in which the free end of the probe is spaced from the tool so that it can be inserted into the tip of the cartridge to rupture the seal. The pivotal mounting of the probe is preferably arranged to releasably retain the probe in its operative and inoperative positions and, as best shown in FIG. 4, the loop 31a on the probe is confined between washers 35 on the bolt and a compression spring 34 is interposed between the lever 11 and a nut 32a on the bolt 32. The compressive spring biases the washers against the loop on the probe and against the lever to provide a friction brake that tends to hold the probe in its moved position. A stop 33 (FIG. 3) can also be provided on the lever 10 to engage the probe 31 and releasably retain it in its inoperative position alongside the lever. As shown, stop 33 is in the form of a head such as the head of a rivet, screw or the like having a wide slot 33a for receiving and retaining the probe 31 intermediate its ends.

From the foregoing it is thought that the construction and use of the hand tool for opening the tapered plastic dispensing tips on material dispensing cartridges will be readily understood. The hand tool is gripped by its handles 13 and 14 and manipulated by the thumb and fingers of the worker, in a manner similar to a pair of shears. The levers are opened to a position as shown in FIG. 1 and the tip T of the dispensing cartridge is inserted through a selected one of the openings 16a–16g corresponding to the desired size of the bead to be dispensed, until the walls of the opening engage the outer surface of the tip to limit insertion and peripherally support the tip. The levers are then moved to their closed position to shear off the projecting portion of the dispensing tip. Since the sharpened edge 18a of the blade 18 is maintained in close sliding engagement with the shear base 15a on the blade 15, the tool forms a clean cut across the dispensing tip substantially free of burrs. If desired, the dispensing tip can be positioned in the opening with the axis of the tip at an angle of less than 90° with respect to the shear blade 15, to enable shearing of the dispensing tip at an angle. After shearing of the dispensing tip, the probe 31 is moved to its operative position as shown in FIG. 3 and inserted into the tip to rupture the seal at the inner end of the tip of the cartridge. An eyelet 33 can be provided on one of the handles to receive a cord or hook for attaching the tool to the belt or clothing of the worker.

The embodiments of the invention in which an exclusive property or privilege is claimed are defined as follows:

1. A hand shear for opening the tapered plastic dispensing tip on a material dispensing cartridge comprising, first and second lever members each having a handle portion at one end, pivot means connecting the other ends of the first and second lever members to each other for movement in a pivot plane, said handle portions each having a finger receiving opening to enable the shear to be held and operated by one hand, said first lever member having a first shear blade portion at a location intermediate the pivot means and the handle portion and providing a shear face generally paralleling said pivot plane, said first blade portion having a plurality of openings extending therethrough of relatively different size each generally corresponding to the external cross-section at different locations along a tapered plastic dispensing tip on a material dispensing cartridge to limit insertion of the tapered tip to a position in which the cross-section of the tapered dispensing tip generally corresponds to the size of the opening and to peripherally support the tapered dispensing tip during shearing, said second lever member having a second shear blade extending laterally thereof and generally paralleling said pivot plane, said second shear blade having a sharpened free edge movable across said shear face and first and second side edges, and first and second blade guide members on the first lever member offset from the locus of the openings in the first blade portion, each having a blade guide portion overlying the outer side of the second blade portion respectively along its first and second side edges to guidably maintain the sharpened free edge of the second blade portion in engagement with the shear face on the first blade portion when the lever members are moved relative to each other to shear an end portion of the dispensing tip.

2. A hand shear according to claim 1 including means for limiting opening movement of said first and second lever members to a position in which said sharpened free edge of the second blade portion overlaps said first blade portion and is outside the locus of the openings in said first blade portion.

3. A hand shear according to claim 1 including an elongated probe pivotally mounted at one end on one of said lever members for swinging movement between an inoperative position extending alongside that lever member and an operative position in which the free end of the probe is spaced from that lever member to enable insertion of the free end of the probe into the tapered dispensing tip after an end portion has been sheared therefrom.

4. A hand shear according to claim 1 including an elongated probe, means pivotally mounting one end of the probe on said first lever member adjacent the handle portion thereof for swinging movement between an inoperative position extending alongside the first lever member and an operative position in which the free end of the probe is spaced from the first lever member to enable insertion of the free end of the probe into the tapered dispensing tip after an end portion has been sheared therefrom.

5. A hand shear according to claim 1 wherein said second blade portion comprises a thin flat resilient blade removably secured to said second lever member.

6. A hand shear according to claim 1 wherein said second lever member has a blade mounting face inclined to converge at a shallow angle toward said shear face on the first lever member, said second blade portion comprising a thin flat resilient blade member removably secured to said blade mounting face on said second lever member to converge at a shallow angle toward said shear face on the first lever member.

* * * * *